United States Patent [19]

Buckley et al.

[11] Patent Number: 4,534,538

[45] Date of Patent: Aug. 13, 1985

[54] MODULAR AIR SHUT-OFF VALVE

[75] Inventors: John J. Buckley, Baltimore; William T. Scott, Ellicott City, both of Md.

[73] Assignee: The United States of America as represented by the Secretary of the Air Force, Washington, D.C.

[21] Appl. No.: 512,083

[22] Filed: Jul. 8, 1983

[51] Int. Cl.[3] ..... F16K 31/143

[52] U.S. Cl. ..... 251/62; 137/527; 137/454.6; 251/306

[58] Field of Search ..... 137/454.2, 454.6, 527; 251/306, 62

[56] References Cited

U.S. PATENT DOCUMENTS 2,936,778 5/1960 Stillwagon ..... 137/454.6

3,568,975 3/1971 Obermaier ..... 251/306 X 4,176,823 12/1979 Gliatas ..... 251/306

*Primary Examiner*—Harold W. Weakley

*Attorney, Agent, or Firm*—Donald J. Singer; Bobby D. Scearce

[57] ABSTRACT

A modular air shut-off valve, particularly useful within the air conditioning environmental control system of an aircraft, is provided, which comprises a housing sized for insertion into a duct of the air conditioning system, a vane pivotally mounted within the housing for pivotal movement between open and closed positions and having flexible portions along its edges contacting the housing in the closed position for providing a resilient seal and to allow pressure relief in the event of overpressure within the duct.

8 Claims, 5 Drawing Figures

MODULAR AIR SHUT-OFF VALVE

RIGHTS OF THE GOVERNMENT

The invention described herein may be manufactured and used by or for the Government of the United States for all governmental purposes without the payment of any royalty.

BACKGROUND OF THE INVENTION

This invention relates generally to aircraft environmental control systems and more particularly to a novel modular air shut-off valve for controlling airflow within an aircraft cooling air duct.

The environmental control systems of certain aircraft, though designed to provide wholly adequate cooling airflow, during flight, to the cockpit and to radar and various avionic systems, may not be designed to provide sufficient cooling to all systems while the aircraft is on the ground on a hot day. It is recognized, however, that when the aircraft is awaiting takeoff, certain systems aboard the aircraft may not need to be fully functional. For example, when the aircraft is on the ground, the radar on board may function only in a standby mode, requiring less than full cooling airflow rates to all portions of the radar system, and therefore the cooling airflow to some portions thereof may be closed off during this period. The capability to control the flow of cooling air as just stated may be essential in order to meet hot-day ground operational requirements of the aircraft.

The present invention provides a modular air shut-off valve for use in the ducts which supply coling air within the environmental control system of an aircraft. The valve has found particular application to control the flow of coolant air to the radar in ground operation modes aboard the aircraft to satisfy specifications for hot-day ground operation. The valve of the present invention comprises a generally rectangularly-shaped vane or damper, mounted on a rotatable shaft within a suitable housing in an air conditioning duct, and having flexible marginal portions contacting the inner surfaces of the housing in the closed position. The vane may therefore be self-adjusting and may serve as a relief valve in the event of overpressure in the duct containing the valve. In the specific embodiment described herein to illustrate a representative structure and built to demonstrate utility of the invention, the valve was configured to control the flow of cooling air to the radar system; the valve was controlled pneumatically using the servo air (about 18 psig) provided by the aircraft for the pressurization of the waveguide; power to the pneumatic system controlling the valve was provided by a 28-volt signal from a squat switch on the landing gear of the aircraft.

It is therefore a principal object of the present invention to provide a modular air shut-off valve.

It is a further object to provide a modular air control valve particularly useful within the environmental control system of an aircraft.

These and other objects of the present invention will become apparent as the detailed description of specific representative embodiments thereof proceeds.

SUMMARY OF THE INVENTION

In accordance with the foregoing principles and objects of the present invention, a modular air shut-off valve, particularly useful within the air conditioning environmental control system of an aircraft, is provided, which comprises a housing sized for insertion into a duct of the air conditioning system, a vane pivotally mounted within the housing for pivotal movement between open and closed positions and having flexible portions along its edges contacting the housing in the closed position for providing a resilient seal and to allow pressure relief in the event of overpressure within the duct.

DESCRIPTION OF THE DRAWINGS

The present invention will be more clearly understood from the following detailed description of specific embodiments thereof read in conjunction with the accompanying drawings wherein.

DETAILED DESCRIPTION

Figure 1:
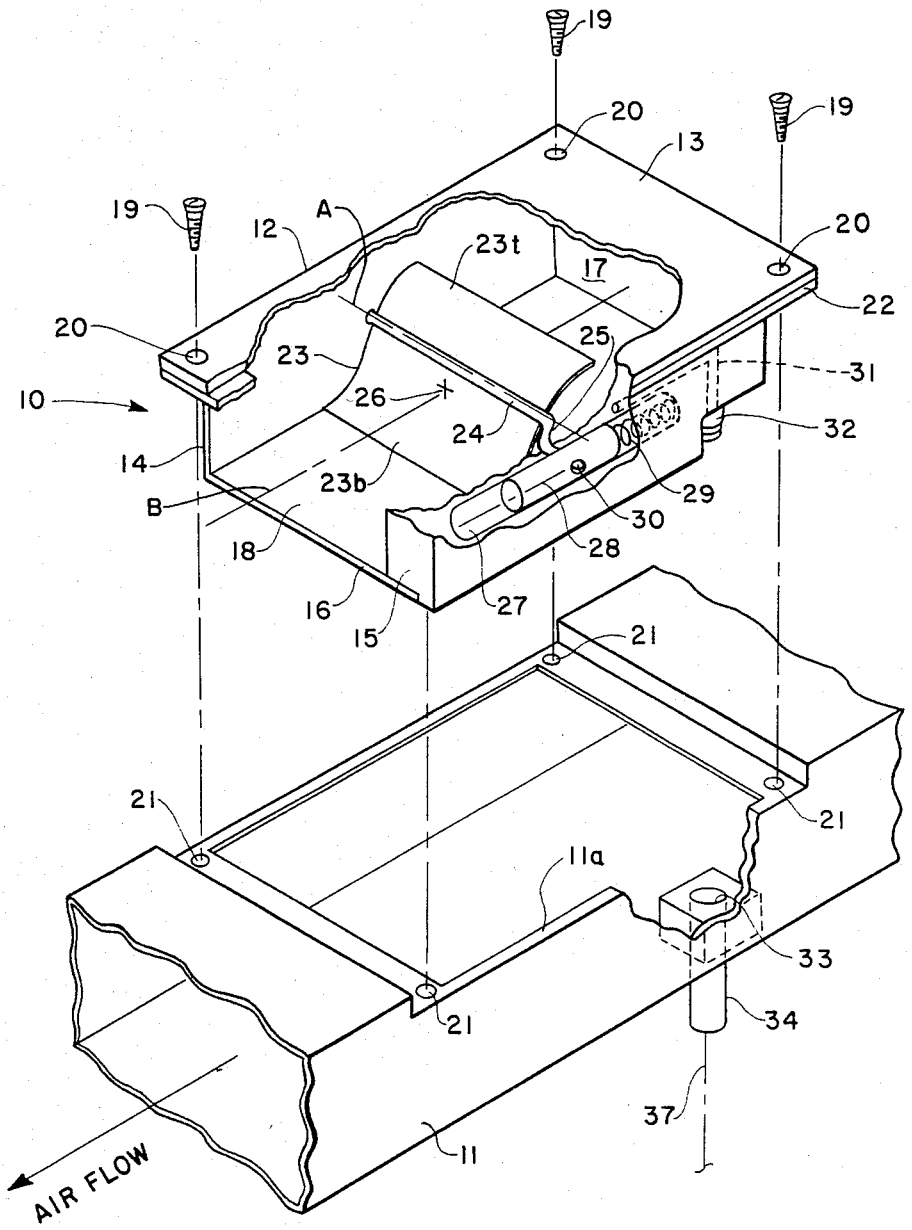
FIG. 1 is an isometric drawing, in partial cutaway of one embodiment of the invention and illustrates the assembly thereof with an air conditioning duct.

Referring now to FIG. 1 of the drawings, shown therein is a preferred representative configuration for the novel modular air shut-off valve 10 of the present invention. Valve 10 is, for clarity, shown detached from an air duct 11 of the aircraft environmental control system into which valve 10 is configured to be received, and is shown in substantial cutaway to expose component parts. Duct 11 is ordinarily constructed to conduct coolant airflow from a source (not shown) for distribution to systems, such as the radar system, the cockpit, avionics systems, etc., requiring air conditioning. Valve 10 comprises a housing 12 including a flanged top plate 13, sidewalls 14, 15, and bottom 16, defining an inlet opening 17 and an outlet opening 18 at respective ends of housing 12, substantially as shown, and a passageway for passage of air therethrough. Housing 12 is sized to be snugly received by an opening provided in aircraft air conditioning duct 11 as shown. In a representative configuration designed for actual use, the overall dimensions of valve 10 were about 2½ inches wide by 2½ inches long by 1 inch high. It is understood, however, that these sizes are illustrative only as size is not limiting of the invention herein. Housing 12 may be secured to duct 11 conventionally as by screws 19 inserted through holes 20 in the flanged ends of top plate 13, and engaging tapped holes 21 in the housing of duct 11. A conventional gasket 22 may be included to provide a desired airtight seal between top plate 13 and the surface 11*a* defining the opening in duct 11 for receiving valve 10.

A substantially rectangularly-shaped damper or vane 23 having flexible top 23*t* and bottom 23*b* marginal portions is sized to fill the cross section of the duct defined through housing 12, and is mounted for pivotal movement about an axis A between open and closed positions. In the closed position, as shown in FIG. 1, top portion 23*t* of vane 23 flexes and resiliently seals against the lower (inner) surface of top plate 13, and bottom portion 23*b* flexes and seals against the upper (inner) surface of bottom plate 16 of housing 12 (or against the bottom of air duct 11 if housing 12 has no, or a partial, bottom 16). In a representative mounting configuration, vane 23 may be supported on a shaft 24 journaled for rotation at a first end into sidewall 14 of housing 12. A crank 25 is formed in, or otherwise attached to the second end of shaft 24 substantially as shown. Shaft 24 is preferably positioned for rotation about axis A intersecting sides 14, 15 of housing 12 above a centerline B through the duct defined by housing 12 (i.e., intermediate the centerline B and top 13) so that the portion of vane 23 (including portion 23*b*) below shaft 24 is somewhat larger than that above shaft 24 (including portion 23*t*). The center of pressure for air flowing through housing 12 may therefore be at a position on vane 23 such as indicated at 26. Vane 23 may comprise any suitable material of construction, or combination of materials, including suitable elastomers, thin metals, molded plastics, high durometer rubbers, polyurethanes, vinyl resins, or the like, of suitable thickness for the purpose herein described. In a representative valve 10 constructed in demonstration of the invention, vane 23 was 0.010 inch thick and comprised fire resistant epoxy fiberglass (FR4).

Pressure actuation means for controlling vane 23 position may be in the form of a cylinder 27 defined within sidewall 15 of housing 12 substantially as shown for receiving a pressure actuated piston 28 and return spring 29 disposed to act on one end of piston 28. The specific embodiment shown in the drawings is representative of a pneumatic system comprising the pressure actuating means. It is understood, however, within the scope hereof, that the actuating means may comprise a hydraulic system. Therefore, respective component parts shown in FIGS. 1 and 2, though described as comprising a pneumatic system, are intended to include the hydraulic equivalents.

A central diametric hole 30 is provided in piston 28, substantially as shown, to receive the crank 25 on the second end of shaft 24. The operative interconnection of crank 25 and piston 28 as described provides for rotation of shaft 24 (and of vane 23), to selectively block the air flowing through duct 11 and the duct defined by housing 12 by the axial movement of piston 28 within cylinder 27. Suitable porting or channeling 31 within wall 15 interconnects cylinder 27 with a connector 32. A mating connector 33 connected to an inlet 34 may be disposed on duct 11 to provide the means to interconnect valve 10 with a source of pressure (not shown in FIG. 1). It is understood that, within the intended scope of these teachings, the location of the fittings 32, 33 and the configuration of the channeling within wall 15 to accommodate the fittings, may be alternatively selected.

Figure 2:
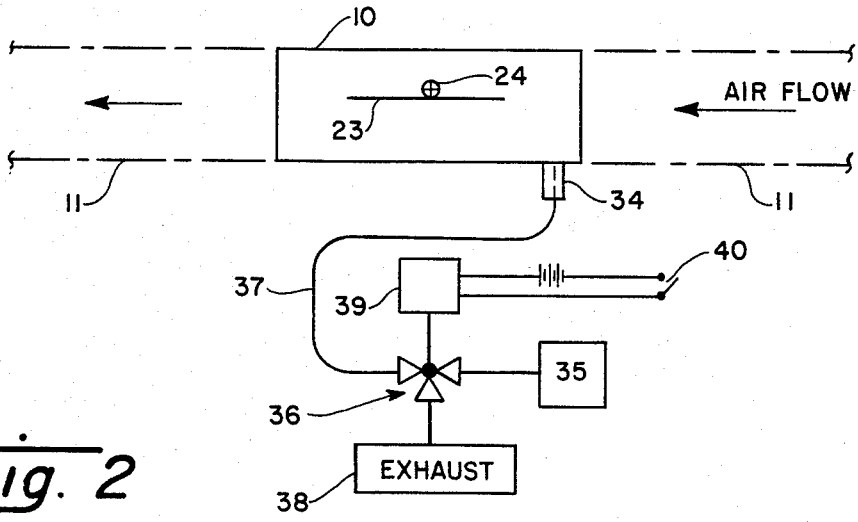
FIG. 2 is a schematic diagram of a pressurizing system suitable for controlling operation of the valve of the present invention.

Referring now additionally to FIG. 2, shown therein is a schematic diagram of a representative pneumatic system interconnected with valve 10 to provide operation of vane 23 for the control of airflow through duct 11. Pneumatic pressure may be available from a pressure source 35 of servo control air (nominally about 18 psig) to supply to valve 10 through a three-way control valve 36 and air line 37. As shown in FIG. 2, the three branches of valve 36 may be connected, respectively, to source 35, valve 10 via line 37, and an exhaust 38. Valve 36 may be controlled by solenoid 39 controlled remotely by a signal or switch such as switch 40. As discussed previously, the switch 40 may be in the form of the squat switch actuated when the aircraft gear is down and supporting the weight of the aircraft, but which opens (deactivates) upon takeoff and retraction of the landing gear. Upon takeoff, solenoid valve 39 closes to vent the pneumatic pressure supplied to valve 10 via valve 36, thereby opening valve 10 to restore airflow through duct 11.

Figure 3A:
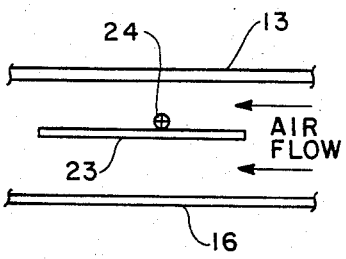
FIGS. 3*a*, 3*b*, and 3*c* are partial sectional views of the valve illustrating operation of the vane.
Figure 3B:
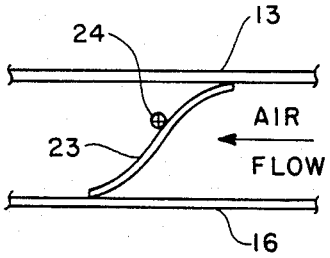
Figure 3C:
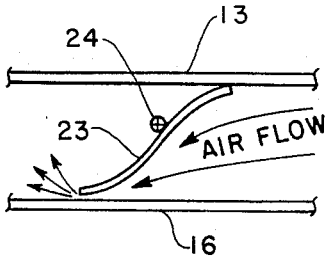

To illustrate the principles of operation of valve 10 of the present invention, reference is now made to FIGS. 3*a*, 3*b*, and 3*c* in conjunction with FIG. 1. FIG. 3*a* illustrates the position vane 23 assumes in the normal (no power) configuration allowing substantially unrestricted airflow through the duct containing vane 23 substantially as shown. Shaft 24 is mounted off (above) center of the duct defined by housing 12, as previously described, in order to provide sufficient aerodynamic moment to maintain vane 23 open when the pressure control mechanism illustrated in FIGS. 1 and 2 is not actuated. The coolant airflow in typical aircraft systems for which valve 10 of this invention is intended for use is normally about ½ to 2 psig, which is ordinarily adequate to provide sufficient aerodynamic moment. Spring 29 acting on piston 28 assists in maintaining vane 23 open when the pressure actuating system is off. It is instructive to note that, in the event of failure of the components comprising the pressure actuating system of FIG. 2, vane 23 will, under the action of spring 29, assume a normal open position to allow airflow through the duct 11.

When pressure is applied to cylinder 27, as through actuation of the system of FIG. 2, the pressure urges piston 28 against spring 29 and in so moving rotates shaft 24 by reason of the interconnection of piston 28 and crank 25. When so actuated, vane 23 assumes the position best depicted in FIG. 3*b* (also illustrated in FIG. 1) wherein the flexible ends of vane 23 are rotated to and deflect against the top 13 and bottom 16 sides defining the duct through housing 12, thereby closing the duct against further airflow. The flexibility of the vane 23 also allows the piston 28 to move its full design travel without overloading the vane by the pneumatically generated torque.

The flexibility of vane 23, and particularly of portion 23*b*, provides an additional advantage of the present invention in the event of unexpected overpressure occurring in the duct when vane 23 is closed. When a condition of overpressure occurs, portion 23*b* of vane 23 may flex such as illustrated in FIG. 3*c* to reduce the pressure differential across vane 23, and to preclude possible consequent structural damage within the air conditioning system of which duct 11 is a part. Excessive overpressure of as low as about 4 psig may be intolerable within the airflow duct 11, which overpressure may be provided for by the function of vane 23 illustrated in FIG. 3*c* without compromising the desirable sealing function at normal (lower) airflow pressure values.

The novel modular air shut-off valve of the present invention is therefore characterized by its compactness, ease of maintenance, reliability, and simplicity of operation; power consumption of the related control systems is minimal during operation of the aircraft on the ground, and no power is required during flight. The novel flexible vane of the valve provides desirable sealing when the valve is actuated, yet allows relief when subjected to overpressure as might otherwise cause structural damage in the environmental control system of the aircraft.

The present invention therefore provides a novel modular air shut-off valve particularly useful in conjunction with the air cooling systems aboard an aircraft, although other applications may be made as might occur to one with skill in the applicable field. All embodiments contemplated hereunder have therefore not been shown in detail. Other embodiments may be developed without departing from the spirit of the invention or from the scope of the appended claims.

We claim:

1. A modular air shut-off valve configured for insertion into an air conditioning duct, comprising:

a. a housing, including first and second pairs of confronting sidewalls, said housing sized for insertion into said air conditioning duct, said walls defining an inlet and an outlet at respective ends of said housing and a passageway of substantially rectangular cross section for passage of air through said housing;

b. a vane mounted between said first confronting sidewall pair for pivotal movement, about an axis intersecting each said first sidewall pair at corresponding points between a first sidewall of said second sidewall pair and a center line extending between said inlet and outlet and defined along said passageway, between a closed position at which said passageway is substantially blocked and an open position at which said passageway is substantially open, said vane having a first portion mounted generally between said axis and said first sidewall of said second sidewall pair for rotation toward said inlet in said open position, and a second portion of area larger than said first portion mounted generally between said axis and the second sidewall of said second sidewall pair for rotation toward said outlet in said open position, each of said portions having flexible margins along corresponding edges of said vane for resiliently contacting said second sidewall pair in said closed position; and c. pressure actuating means connected to said vane for selectively pivoting said vane between said open and closed positions.

2. The valve as recited in claim 1 wherein said actuating means includes a pneumatically operated piston operatively connected to said vane.

3. The valve as recited in claim 1 wherein said actuating means includes a hydraulically operated piston operatively connected to said vane.

4. The valve as recited in claim 1 wherein said flexible margins of said vane comprise an elastomer.

5. A modular air shut-off valve configured for insertion into an air conditioning duct, comprising:

a. a housing, including first and second pairs of confronting sidewalls, said housing sized for insertion into said air conditioning duct, said walls defining an inlet and an outlet at respective ends of said housing and a passageway of substantially rectangular cross section for passage of air through said housing;

b. a shaft journaled at its respective ends in said first confronting sidewall pair for rotation about an axis intersecting said first sidewall pair between a first sidewall of said second sidewall pair and a center line defined along said passageway between said inlet and outlet;

c. a vane attached to said shaft for rotation therewith, between an open position at which said passageway is substantially open and a closed position at which said passageway is substantially closed, said vane having a first portion mounted generally between said shaft and said first sidewall of said second sidewall pair and a second portion of size larger than said first portion mounted generally between said shaft and the second sidewall of said second sidewall pair and having flexible marginal portions along corresponding edges thereof for resiliently contacting said second sidewall pair in said closed position, said vane mounted for rotation of said second portion toward said outlet in said open position:

d. a crank attached to one end of said shaft: and e. pressure actuating means operatively connected to said crank for selectively pivoting said vane between said open and closed positions by rotation of said shaft about said axis.

6. The valve as recited in claim 5 wherein said actuating means includes a pneumatically operated piston operatively connected to said crank.

7. The valve as recited in claim 5 wherein said actuating means is a hydraulically operated piston operatively connected to said crank.

8. The valve as recited in claim 5 wherein said flexible marginal portions of said vane comprise an elastomer.

* * * * *